US005158426A

United States Patent [19]

Casaro et al.

[11] Patent Number: 5,158,426

[45] Date of Patent: Oct. 27, 1992

[54] STATOR ASSEMBLY FOR A TURBOMOLECULAR PUMP

[75] Inventors: Fausto Casaro; Dario Inserra; Giampaolo Levi; Paolo Pellizzari, all of Turin, Italy

[73] Assignee: Varian Associates, Inc., Palo Alto, Calif.

[21] Appl. No.: 656,361

[22] Filed: Feb. 15, 1991

[30] Foreign Application Priority Data

Feb. 16, 1990 [IT] Italy ..... 67113 A/90

[51] Int. Cl.[5] ..... F01D 1/12

[52] U.S. Cl. ..... 415/52.1; 415/58.5; 415/191; 415/199.5; 415/214.1; 415/914; 403/340; 403/344

[58] Field of Search ..... 415/182.1, 183, 185, 415/191, 208.1, 214.1, 198.1, 199.4, 199.5, 914, 52.1, 58.4, 58.5, 90; 403/340, 344, 364, 381

[56] References Cited

U.S. PATENT DOCUMENTS

| | | | |
|---|---|---|---|
| 416,592 | 12/1889 | Gilbert | 403/344 |
| 3,004,700 | 10/1961 | Warren | 415/214.1 |
| 3,741,680 | 6/1973 | Killmann et al. | 415/214.1 |
| 3,826,588 | 7/1974 | Frank | 415/90 |
| 4,309,143 | 1/1982 | Klatt et al. | 415/90 |
| 4,832,564 | 5/1989 | Holss et al. . | |
| 5,059,092 | 10/1991 | Kabelitz et al. | 415/90 |

FOREIGN PATENT DOCUMENTS

| | | | |
|---|---|---|---|
| 2214702 | 9/1973 | Fed. Rep. of Germany . | |
| 2523390 | 5/1976 | Fed. Rep. of Germany . | |
| 84100 | 10/1964 | France . | |
| 1508546 | 1/1968 | France | 403/340 |
| 1155700 | 6/1969 | United Kingdom . | |
| 2155103 | 9/1985 | United Kingdom . | |

OTHER PUBLICATIONS

Soviet Union Certificate No. 033,528, "Turbo Molecular Vacuum Pump", Mar. 1986.

Patent Abstract, Japan, App. No. 63-13581, "Vacuum Pump", Publication No. 190990, Published Aug. 1989.

*Primary Examiner*—Edward K. Look

*Assistant Examiner*—Christopher M. Verdier

*Attorney, Agent, or Firm*—Edward H. Berkowitz

[57] ABSTRACT

In a stator assembly for a turbomolecular pump, each stator is assembled from two semicircular portions mutually aligned and secured in place by tongue and grooves means, each such stator including a plurality of radially directed blades connecting an inner circular edge and outer circular edge of the stator, such edges occupying respective parallel displaced planes. The outer edge of each stator includes regularly outward projected tabs which bear between spacer rings to maintain axial alignment.

6 Claims, 2 Drawing Sheets

STATOR ASSEMBLY FOR A TURBOMOLECULAR PUMP

BACKGROUND OF INVENTION

The present invention relates to a stator for a turbomolecular pump.

In a turbomolecular pump the rotor impellers are interleaved with stator discs fixed to spacer rings located against the inner wall of the pump housing. Although it is possible to precise the machine the inner wall of the pump housing, the periphery of the stator disks and the spacer rings, it is almost impossible to prevent formation of interstices between the outer surface of the stator and the inner wall of the pump housing. Because of the large pressure difference existing between the suction side (high vacuum side) and the delivery side (low vacuum side) of a turbomolecular pump, a back streaming gas flow can be established through such interstices from the delivery side to the suction side; that is, a stream opposite to the pumping direction which, although involving tiny gas amounts, results in a considerable worsening of the pump performance. Several approaches have been proposed to overcome this problem.

For example, in U.S. Pat. No. 4,832,564 there are provided radial ducts in the spacer rings in order to establish communication between the outside of the stator group and the inner space thereof where the pumping takes place. Since the gas conductance of these ducts is greater than that of the interstices existing between the stator group and the pump housing, the back streaming gas has a high probability of passing through the stator inner space, and thus to be pumped away.

In German Patent Application No. 2,214,702 the gas back streaming directed towards the suction side is blocked by annular seal gaskets fitted between the pump housing and the stator group.

Nevertheless these solutions are not without disadvantages due, in the first case, to the necessity of special machining of the spacer rings, and in the second case to possible sealing defects of the annular gaskets fitted between the pump housing and the stator group.

Further, the known stator discs for turbomolecular pumps comprise substantially flat structures that render troublesome the assembling between the spacer rings and do not allow of an easy positioning of each stator disc at the desired intermediate location between two adjacent impellers of the rotor. Finally, because of the construction as two separate parts of each stator disc, misalignments are possible along the diametrical division line.

The object of the present invention is to eliminate or at least to reduce the above drawbacks of the known stators for turbomolecular pumps, by providing stators that are capable of eliminating or minimizing, through simple and reliable means, the back streaming of gas from the delivery side to the suction side of the pump.

Another object of the invention is to provide stator groups wherein the assembly of each stator disc between the spacer rings is easy.

An additional, object of the invention is to provide stator discs adapted to be positioned at the optimum intermediate locations between adjacent rotor impellers.

SUMMARY OF THE INVENTION

The above and other objects and advantages of the invention will become evident from the following description are achieved through a stator group for a turbomolecular pump comprising a plurality of stator discs with blades, each having a circular peripheral edge and formed in two parts, which in turn are fastened by means of spacer rings that are interleaved with said stator discs, said peripheral edges of the stator discs being equipped with a series of radial projections for the fastening between said spacer rings.

According to another characteristic of the invention the overall shape of each stator disc is frusto-conical.

According to a further characteristic of the invention the two separate parts making up each stator disc are joined together by means of tongues which keep them aligned.

A preferred embodiment of the invention will now be described, as a non-limiting example, with reference to the attached drawings.

DESCRIPTION OF A PREFERRED EMBODIMENT

Figure 1:
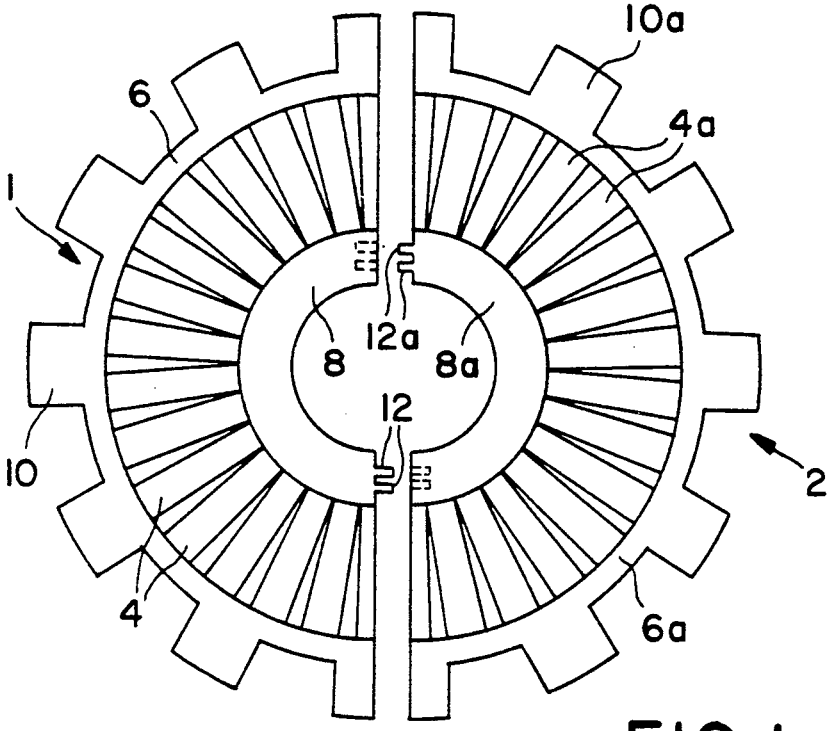
FIG. 1 is a top plane view of a stator disc according to the invention, with the two halves shown as separated.
Figure 2:
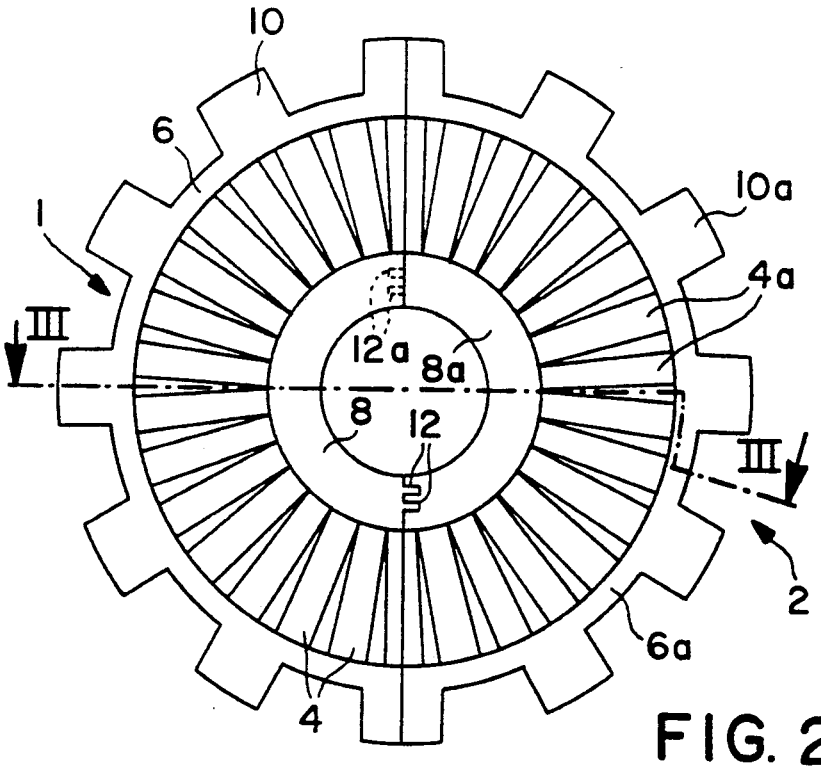
FIG. 2 is a top plane view of the stator disc of FIG. 1, with the two halves joined together.
Figure 3:
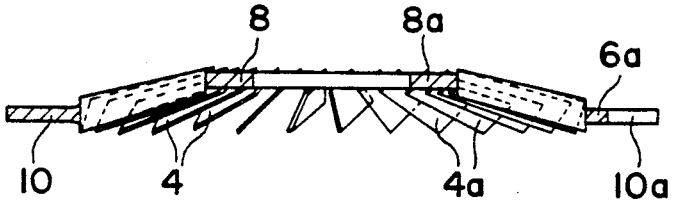
FIG. 3 is a cross-section view along line III—III in FIG. 2.

With reference to FIGS. 1, 2 and 3 there is shown a stator disc for a turbomolecular pump made of two separate parts 1 and 2 having a semicircular shape and adapted to be joined together upon assembling the stator group as shown in FIG. 2. Each part comprises a plurality of blades 4 or 4*a*—in a known manner—ending at opposite sides with semicircular edges, 6, 8 and 6*a*, 8*a*.

According to a characteristic of the invention, each outer edge 6, 6*a* is provided with projections or tabs 10, 10*a*, respectively, radially extending outwardly from the disc along its whole circumference, in such a way as to form the fastening members for each stator disc as will be described below.

It is seen in FIG. 3, the stator disc according to the invention has a frusto-conical shape determined by the oblique or tilted arrangement of the blades 4, 4*a* with respect to the outer edges 6, 6*a* and the tabs 10, 10*a* lying in a single plane that is perpendicular to the stator axis. The inner edges 8, 8*a* lie in a plane that is parallel to that of the outer edges 6, 6*a*. Each part 1, 2 is equipped at the edge thereof with tongues 12, 12*a* adapted to join together the two parts 1 and 2 at their inner zone and to keep them coplanar along a diametrical line of division.

Figure 4:
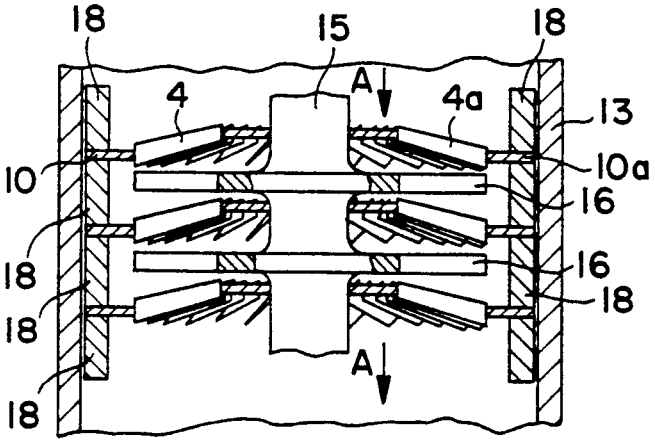
FIG. 4 is a cross-section view of a portion of the stator group mounted in a turbomolecular pump.

FIG. 4 schematically and partially illustrates the stator group of the invention assembled in a turbomolecular pump.

Reference numeral 13 designates the cylindrical housing of the turbomolecular pump within which a rotor is contained which comprises a self-supporting shaft 15 integral with a series of bladed impellers 16, in a known manner. Between each pair of adjacent rotor impellers there is inserted one of the above described stator discs. Each stator disc is fastened between two spacer rings 18 by means of radial tabs 10, 10*a*. The construction of the stator disc with a frusto-conical shape makes the assembly of the stator group quite easy and allows for minimizing the gaps between the impellers.

Figure 5:
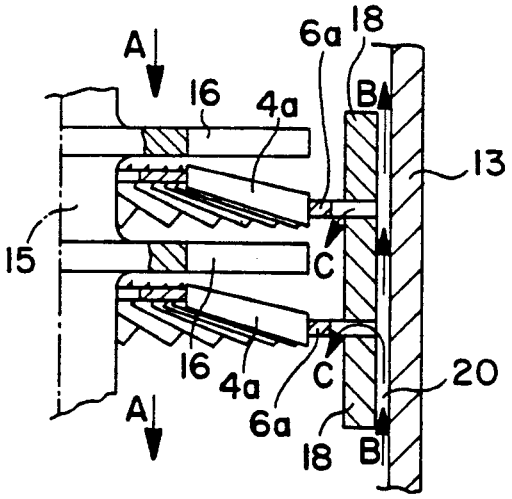
FIG. 5 is a view showing an enlarged detail of FIG. 4.

In FIG. 5 there is shown an enlarged detail of FIG. 4, illustrating how the stator of the invention facilitates pumping away from the inside of the pump, the backstreaming gas coming from the delivery side. Reference numeral 20 designates the interstitial gap (shown exaggeratedly large) that may exist between the stator group and the wall 13 of the pump. Pumping takes place along the direction shown by the arrow A, that is from the high vacuum (upper) side to the delivery or forevacuum (lower) side. Backstreaming gas is assumed to be coming from the delivery side and directed as indicated by arrow B, that is towards the suction side; such back streaming results in a worsening of the high vacuum level achieved by the pump. As a result of the disclosed construction for the stator discs, the back streaming gas can pass through the gaps defined between each tab or radial projection 10, 10*a*, as shown by arrow C in FIG. 5, and thus reach the inner space of the pump where it is again pumped away along the direction of arrow A.

Therefore, as a result of the improved structure of the stator discs, the stator according to the present invention achieves advantages both in respect to the pump performance and the assembling thereof.

A preferred embodiment of the invention has been described, but of course this latter can be subjected to several modifications and changes all coming within the scope of the attached claims.

We claim:

1. A stator group for a turbomolecular pump comprising:

a first plurality of stator disks disposed in axial alignment, each said stator comprising a circular outer peripheral edge with a plurality of radially outwardly directed projections on the outer periphery of said disk, said group having a high pressure end and a low pressure end;

a plurality of spacer rings, at least one of said spacer rings disposed between consecutive said stator disks, whereby the axial alignment of said stators is secured by said spacer rings bearing against said projections.

2. The stator group of claim 1 further comprising a high pressure end stator and a low pressure end stator at respective high pressure and low pressure ends of said stator group, a high pressure end spacer ring disposed axially to the high pressure end of said high pressure stator and a low pressure end spacer ring disposed to the low pressure side of said low pressure stator to secure said high pressure and low pressure end stators in axial alignment.

3. The stator group of claim 2 comprising a cylindrical housing for retaining said spacer rings for axial alignment.

4. The stator group of claim 3 wherein each said stator comprises an inner circular edge and a plurality of blades, each said blade secured at one end thereof to said inner circular edge and at the other end thereof secured to said outer peripheral edge, said inner and outer peripheral edges respectively planes spaced apart axially, whereby each said stator defines a frusto-conical shape.

5. The stator group of claim 4 wherein each said stator comprises two portions, each said portion adopted for mutual joinder therebetween by tongue means and a tongue receiving means of respective portions.

6. The stator group of claim 1 wherein said spacer ring comprises an inner diameter, said inner diameter greater than the outer diameter of said circular outer peripheral edge of said stators, said outer diameter measured between said projections.

* * * * *